US006951703B2

(12) United States Patent
Chae et al.

(10) Patent No.: US 6,951,703 B2
(45) Date of Patent: Oct. 4, 2005

(54) LIQUID DEVELOPER FOR DEVELOPING LATENT ELECTROSTATIC IMAGE AND METHOD FOR PREPARING THE SAME

(75) Inventors: Seong-joon Chae, Seoul (KR); Kyung-yol Yon, Gyeonggi-do (KR); Joong-hwan Choi, Seoul (KR); Jeong-hun Pang, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 261 days.

(21) Appl. No.: 10/423,985

(22) Filed: Apr. 28, 2003

(65) Prior Publication Data

US 2004/0002014 A1 Jan. 1, 2004

(30) Foreign Application Priority Data

Jun. 15, 2002 (KR) ..... 10-2002-0033478

(51) Int. Cl.[7] ..... G03G 9/00

(52) U.S. Cl. ..... 430/114; 430/115; 430/137.22; 430/137.12

(58) Field of Search ..... 430/114, 115, 430/137.22, 137.12

(56) References Cited

U.S. PATENT DOCUMENTS

| | | | | |
|---|---|---|---|---|
| 5,407,771 A | | 4/1995 | Landa et al. | |
| 5,652,282 A | | 7/1997 | Baker et al. | |
| 5,876,896 A | | 3/1999 | Suda et al. | |
| 5,958,640 A | * | 9/1999 | Hasegawa et al. | 430/110.2 |
| 2002/0192583 A1 | * | 12/2002 | Marsh et al. | 430/106.1 |

* cited by examiner

*Primary Examiner*—Mark A. Chapman
(74) *Attorney, Agent, or Firm*—Staas & Halsey LLP

(57) ABSTRACT

A liquid developer for high-quality image reproduction and a method of preparing the liquid developer. The liquid developer exhibits good pigment dispersion by the introduction of organosol. The liquid developer contains fine toner particles of a uniform size with a volume-average to number-average particle diameter ratio of 1.5–2.5, and thus can produce high-resolution images. The liquid developer preparation method is environmentally friendly, simple, and cost effective because no cosolvent is used, thus eliminating the need for a cosolvent removal process.

18 Claims, 6 Drawing Sheets

LIQUID DEVELOPER FOR DEVELOPING LATENT ELECTROSTATIC IMAGE AND METHOD FOR PREPARING THE SAME

CROSS-REFERENCE TO RELATED APPLICATIONS

This application claims the benefit of Korean Application No. 2002-33478, filed Jun. 15, 2002, in the Korean Intellectual Property Office, the disclosure of which is incorporated herein by reference.

BACKGROUND OF THE INVENTION

1. Field of the Invention

The present invention relates to a liquid developer, and more particularly, to a high-resolution liquid developer and a method for preparing the same.

2. Description of the Related Art

Printers can be classified into laser printers and inkjet printers. Laser printers form a latent image on a photoconductor using a laser and a toner image from the latent image by applying toner to the photoconductor using a potential difference, and transfer the toner image to paper to obtain a desired image. Inkjet printers are known to be unsuitable for a high throughput task directed by a plurality of computers connected via a network because the printing speed of the inkjet printer is slow.

Most laser printers in current use are black-and-white dry-type printers. In dry-type printers, a solid toner is caused to frictionally charge the air to migrate onto a latent image formed on an organic photoconductor (OPC). However, it is known that the use of solid toner particles raises environmental concerns due to toner scatter, and image quality is limited. In wet-type printers, a toner dispersion is used. The solvent of the toner dispersion serves as a carrier for toner particles migrating to the latent image on the OPC, and thus the development process is less affected by ambient factors, such as temperature and humidity. Also, the environmental concerns due to toner scatter can be overcome by the use of liquid toners. Toner particles for use in the wet-type printer can be controlled to be much smaller than those for dry-type printers (having a particle size greater than 6 $\mu$m), resulting in quality images.

There are two types of liquid toners. The first is a resin-based common toner, and the second is an organosol toner using self-stable organosols. Self-stable organosols refer to colloidal particles (0.1–1 micron diameter) synthesized by non-aqueous dispersion polymerization in a low-dielectric hydrocarbon solvent. These organosol particles enhance the dispersion properties of colorants to be resistant to sedimentation and aggregation. In the most commonly used non-aqueous dispersion polymerization method, one or more ethylenically-unsaturated (typically acrylic) monomers, soluble in a hydrocarbon medium, are polymerized in the presence of a preformed amphipathic polymer (stabilizer). The stabilizer amphipathic polymer includes two distinct repeat units, one essentially insoluble in the hydrocarbon medium, the other freely soluble. When the polymerization continues to proceed beyond a critical molecular weight, the solubility limit is exceeded and the polymer precipitates, forming a core particle. The amphipathic polymer then either adsorbs onto or covalently bonds to the core, which continues to grow until the monomer is depleted. The amphiphathic polymer "shell" acts to stabilize the growing core particles with respect to aggregation. The resulting core/shell polymer particles are spherical, and have a diameter in the range of 0.1–0.5 microns.

The resolution of laser printers is known to be closely associated with toner particle diameter. Various attempts have been made to improve the resolution of printer toners.

In a method disclosed in U.S. Pat. No. 5,407,771, as shown in FIG. 1, initially a pigment, a dispersant, and a resin are mixed with a solvent and stirred at a temperature of 65–100° C. until the components are thoroughly mixed. Once the components have been thoroughly mixed, the temperature of the reactor is slowly dropped to precipitate solid resin from the melted resin. The isolation of the solid resin results in solid ink, and the solid ink is ground using a cutter or grinder for 75 hours with an addition of a solvent, resulting in a liquid developer. A charging control agent (CCA) to provide the liquid toner with electrostatic properties is added after or during the wet milling. This conventional process is complicated and costly because it involves high-temperature mixing and long-time milling. Also, the initial particle size or the dispersion properties of the pigment used for the formation of toner particles considerably affects the final toner particle diameter. Therefore, it is difficult to obtain toner particles of a uniform size.

A liquid developer preparation method using a cosolvent is disclosed in U.S. Pat. No. 5,876,896. In this method, as shown in FIG. 2, a pigment, a resin, a cosolvent, a solvent, and a dispersant are placed in a reactor and are stirred while maintaining the reactor at a temperature at which the resin is soluble in the cosolvent and solvent. Next, the temperature is slowly dropped to precipitate the resin shelling the pigment, so that toner particles are obtained. Next, the cosolvent is replaced by a hydrocarbon solvent, followed by an addition of a CCA to complete the preparation of a liquid toner. According to this method, the final toner particle diameter and its distribution are controlled by adjusting a mixing ratio of two liquids constituting the cosolvent as a solubility parameter (SP value) of the carrier liquid. However, the use of cosolvent, usually, toluene, is hazardous for the human body and raises environmental problems.

U.S. Pat. No. 5,652,282 discloses a liquid developer using organosols. However, since the liquid developer contains toner particles as large as 3.1–3.5 $\mu$m, a defective flow pattern appears, as shown in FIG. 3, after development onto the OPC by a developing roller. As a result, the final image is also indistinct and has very irregular thicknesses, as is apparent from FIG. 4.

SUMMARY OF THE INVENTION

Accordingly, it is an aspect of the present invention to provide a high-resolution liquid developer in which the dispersion properties of a pigment are improved using organosols and which contains toner particles having a fine, uniform size of several microns or less.

It is another aspect to provide a simple, environmentally safe method to prepare a high-resolution liquid developer having a fine and uniform toner particle distribution.

Additional aspects and advantages of the invention will be set forth in part in the description which follows and, in part, will be obvious from the description, or may be learned by practice of the invention.

The foregoing and/or other aspects may be achieved by providing a liquid developer including an organosol, a pigment, a charge control agent, and a hydrogen solvent, and having a volume-average to number-average particle diameter ratio of 1.5–2.5.

The foregoing and/or other aspects may be achieved by providing a method of preparing a liquid developer, the method including synthesizing an organosol using ethymethacrylate (EMA) for a core and lauryl methacrylate (LMA) for a shell; mixing the organosol with a pigment in a mass ratio of 1:4–1:10; adding a charge control agent to the mixture until the mass ratio of the charge control agent to the pigment is in the range of 1:0.055–1:0.025 and mixing the mixture with a hydrocarbon solvent while adjusting the solid percentage in the resulting dispersion; and milling the dispersion while monitoring a ratio of the volume-average particle diameter to the number-average particle diameter to be in the range of 1.5–2.5.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DESCRIPTION OF THE PREFERRED EMBODIMENTS

Figure 1:
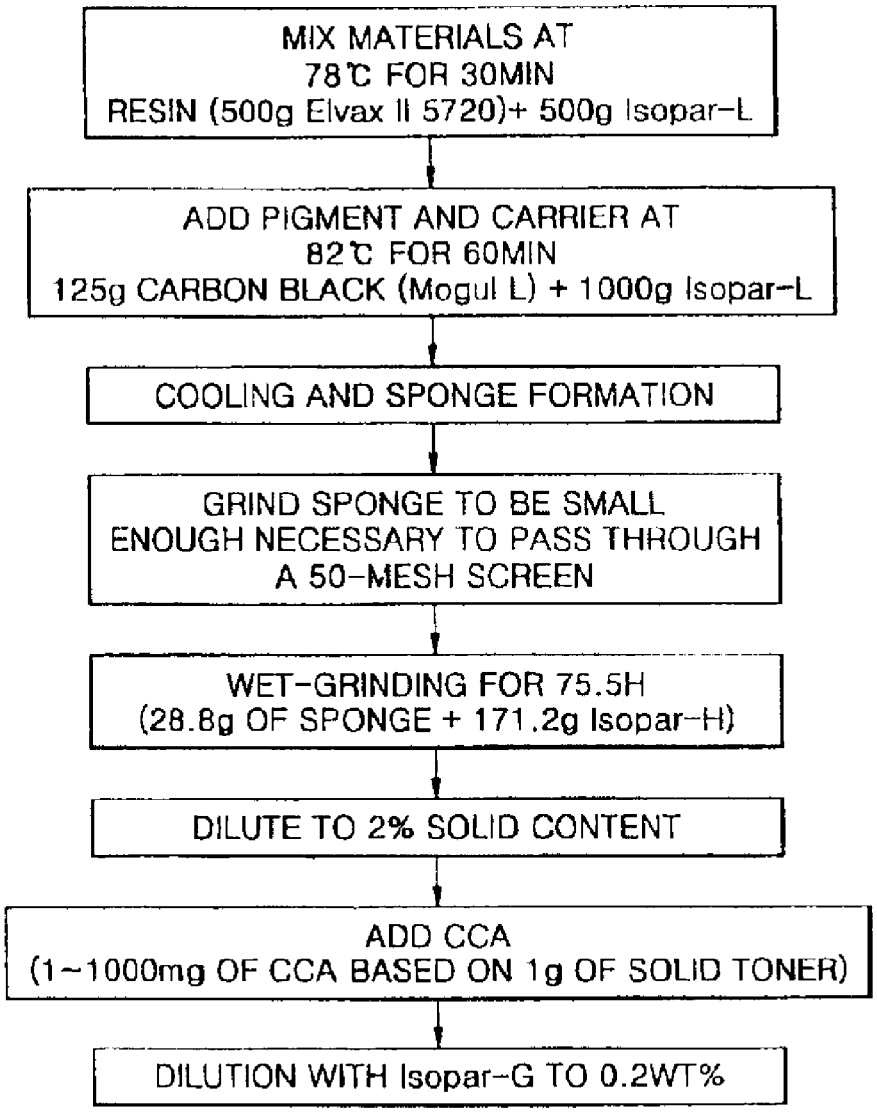
FIG. 1 (PRIOR ART)
FIG. 1 is a flowchart of a conventional developer preparation method.
Figure 2:
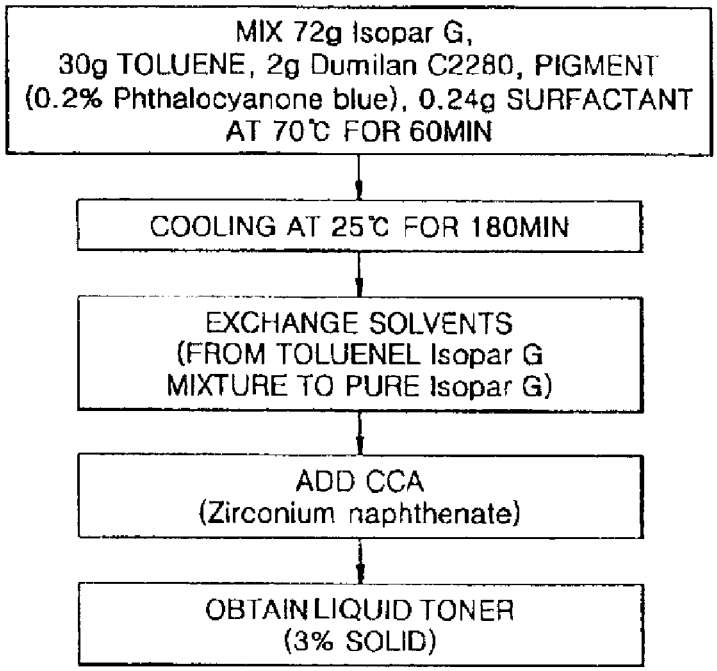
FIG. 2 (PRIOR ART)
FIG. 2 is a flowchart of another conventional developer preparation method.

Reference will now be made in detail to the present preferred embodiments of the present invention, examples of which are illustrated in the accompanying drawings, wherein like reference numerals refer to like elements throughout.

A liquid developer according to an embodiment of the present invention includes a pigment, which determines the color of the liquid developer (toner) and considerably affects the electrical properties of the liquid developer, and an organosol, which uniformly disperses the pigment in a solvent to enhance dispersion properties and determine the glass transition temperature (Tg) and melting properties of the liquid toner. The liquid developer further includes a carrier solvent, which serves as a dispersion medium for the liquid toner and is electrically nonconductive to enable selective migration of only the toner particles dispersed in the medium in an electric field, and a charging control agent (CCA) providing electrical properties to the liquid toner.

In the liquid developer according to the present invention, toner particles may have a volume-average to number-average particle diameter ratio (hereinafter, a Dv/Dn value) in the range of 1.5–2.5. Specifically, the range may be 1.7–2.0. The D v/Dn value can be controlled by varying milling rate, milling time, and the amount of beads added in milling together with the toner particles. The toner particle diameter of the liquid toner can be measured using an LA 910 apparatus (HORIBA CO.), and the volume-average and number-average particle diameters of the toner particles can be calculated using the measured results. Number-average particle diameter refers to the average diameter of toner particles calculated using the number of toner particles for each different size, and volume-average particle diameter refers to the average diameter of toner particles calculated using the volume ratio of toner particles for each size to the total volume of the toner particles. When the distribution range of toner particles having different diameters is wide, the Dv/Dn value is large. When the distribution range of toner particles having different diameters is narrow, the Dv/Dn value approaches 1. When the Dv/Dn value is equal to 1, it means that the toner particles have the same diameter. For a Dv/Dn value approximate to 1, a very high milling rate and a longer period of milling are required, but this is impractical. Also, if the milling rate is too high, the physical properties of the organosol degrade, although the Dv/Dn value almost equal to 1 can result, and the toner particles agglomerate after milling.

The organosol used in the embodiment of the present invention contains a thermoplastic resin as a core and an amphipathic stabilizer as a shell. The thermoplastic resin forming the core, which is insoluble, is derived from monomers through polymerization. Any monomer and stabilizer common to one of ordinary skill in the art can be used for the organosol without limitations. However, as an example, ethylmethacrylate (EMA) may be used for the monomer core and lauryl methacrylate (LMA) may be used for the stabilizer shell.

A variety of commonly known pigments may be used. However, as an example, phthalocyanine blue, monoarylide yellow, diarylide yellow, arylamide yellow, azo red, quinachridone magenta, naphthol yellow, carbon black, or a mixture of the foregoing pigments may be used.

Any CCA may be used. For example, ionic compounds, such as metal salts of fatty acids, metal salts of sulfosuccinates, metal salts of oxyphosphates, metal salts of alkylbenzenesulfonic acid, metal salts of aromatic carboxylic acids or sulfonic acids, as well as zwitterionic and non-ionic compounds, such as polyoxyethylated alkylamines, lecithin, polyvinylpyrrolidone, etc. may be used. Lecithin, basic barium petronate, or calcium petronate can be used for the negative CCA.

According to the present embodiment, ISOPAR G, ISOPAR H, ISOPAR M, ISOPAR V, NORPAR 12, or NORPAR 15 can be used for the hydrocarbon solvent. When the volume-average particle diameter of toner particles is less than or equal to 1.3 $\mu$m, quality images can be obtained.

A method of preparing a liquid developer according to the present involves synthesizing an organosol using ethylmethacrylate (EMA) for a core and lauryl methacrylate (LMA) for a shell; mixing the organosol with a pigment in a mass ratio of 1:4–1:10; adding a CCA to the mixture until the mass ratio of the CCA to the pigment is in the range of 1:0.055–1:0.025 and mixing the mixture with a hydrocarbon solvent while adjusting the solid percentage in the resulting dispersion; and milling the dispersion while monitoring the Dv/Dn value of toner particles within the range of 1.5–2.5.

A higher solid content in the dispersion results in finer pigment particles approximate to the primary particle size in a milling process. Accordingly, it is important to provide a uniform pigment particle size distribution after milling, by increasing the solid content of the dispersion. However, if the solid content of the dispersion exceeds 25% by weight, the viscosity of the dispersion becomes too great for milling to be performed. A smaller size of pigment particles in the dispersion results in finer toner particles.

In the liquid developer preparation method according to the embodiment of the present invention, the mass ratio of the organosol to the pigment may be in the range of 1:4–1:10. If the mass ratio of the organosol to the pigment is less than 1:4, an appropriate optical density of images cannot be obtained. If the mass ratio of the organosol to the pigment exceeds 1:10, images cannot be tightly fused to paper.

In the liquid developer preparation method according to the embodiment of the present invention, the milling rate may be in the range of 100–10,000 rpm and the milling time may be in the range of 0.3–24 hours. A higher milling rate and longer milling duration enhance the dispersion properties of the pigment particles and thus result in smaller final toner particles. If the milling rate exceeds 10,000 rpm, excess heat is generated during milling and the temperature of the reactor rapidly rises so that the conductivity and the amount of liquid toner developed in a unit area may decrease. When the temperature of the reactor suddenly rises, the physical properties of organosol degrade, causing aggregation of the toner particles after milling, as described above.

According to the present embodiment, the mass ratio of the CCA to the pigment may be in the range of 1:0.005–1:0.025. If the mass ratio of the CCA to the pigment is less than 1:0.005, toner particles are too strongly charged, generating a repulsive force between the toner particles, and thus an appropriate optical density of images cannot be obtained. If the mass ratio of the CCA to the pigment is greater than 1:0.025, toner particles are too weakly charged so that an appropriate optical density of images cannot be obtained.

In the liquid toner preparation method according to the present invention, milling can be performed using a lateral milling technique, such as basket milling, attrition milling, or Dino milling. In the milling process, ceramic beads may be formed of zirconia to avoid an effect on the charge of the toner particles.

The present embodiment will be described in greater detail with reference to the following examples which are for illustrative purposes and are not intended to limit the scope of the invention.

EXAMPLE 1

Hydrocarbon solvent NORPAR 12, pigment PR81:4 magenta, and EMA/LMA organosol were mixed together so that the mass ratio of the organosol to the pigment is 1:5. Also added to the mixture were a 1% charge control agent zirconium octanoate, with respect to the amount of the pigment, and glass beads of 0.5 mm. The mixture was milled in a Torus mill (GETZMANN CO.) at 35° C. while measuring the Dv/Dn value of particles using an LA 910 apparatus (HORIBA CO.). As a result, a liquid developer (toner) having a Dv/Dn value of 1.81 was obtained. The mass ratio of the glass beads to the mixture was 1:1, the milling rate was 5000 rpm, and the milling time was 1 hour.

EXAMPLE 2

A liquid developer was prepared in the same manner as in example 1, except that milling was performed at 7,000 rpm for 10 hours.

EXAMPLE 3

A liquid developer was prepared in the same manner as in example 1, except that milling was performed for 20 hours.

The liquid developers prepared in examples 1 through 3 had a Dv/Dn value of 1.81, 1.71, and 1.76, respectively.

Figure 3:
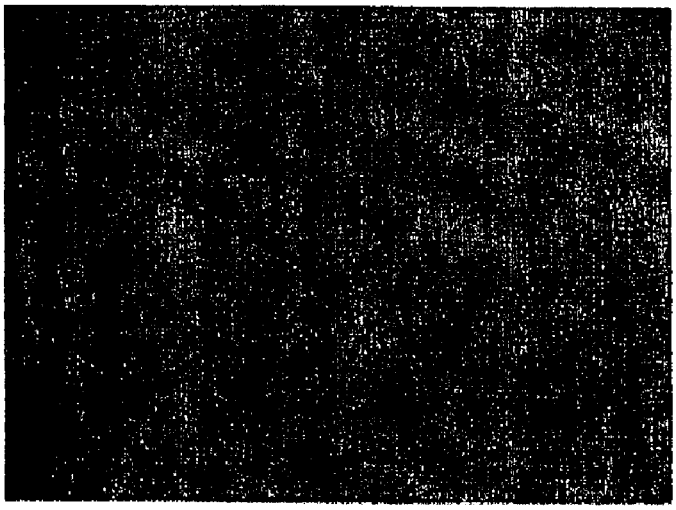
FIG. 3 (PRIOR ART)
FIG. 3 shows a defective flow pattern on the developed image using a conventional liquid developer containing organosols.
Figure 4:
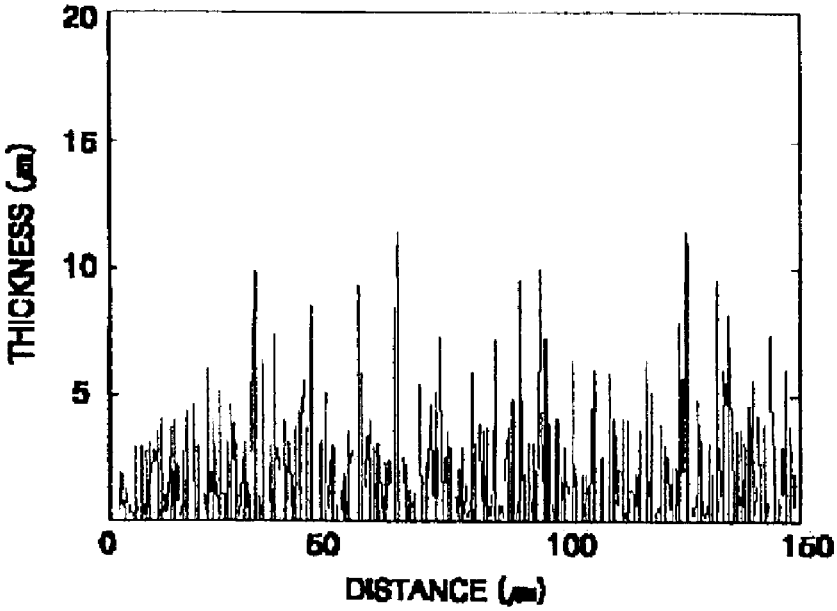
FIG. 4 (PRIOR ART)
FIG. 4 is a graph of the distribution of thicknesses of an image developed using the conventional liquid developer of FIG. 3.

As described above with reference to FIGS. 3 and 4, when the conventional liquid developer containing an organosol was used, the resolution of printed images was poor due to the defective flow pattern on the images, and the printed images had irregular thickness distributions in the range of 2–12 $\mu$m.

Figure 5:
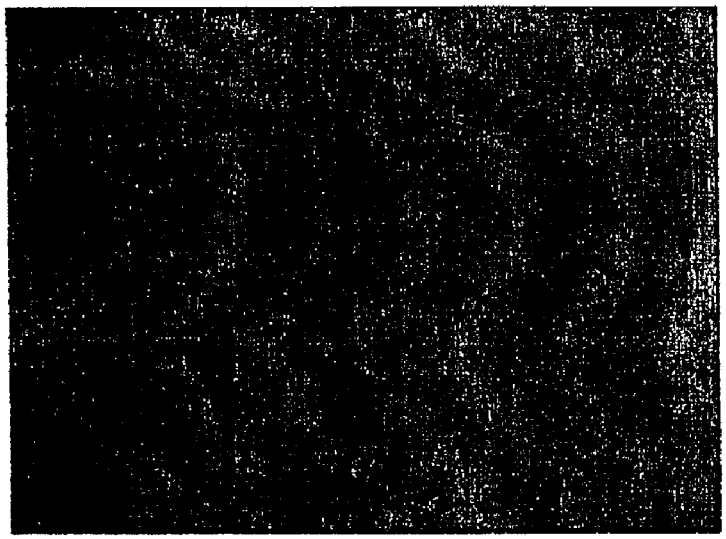
FIG. 5 shows an image without a defective flow pattern developed using a liquid developer having a Dv/Dn value of 1.81, according to the present invention.
Figure 6:
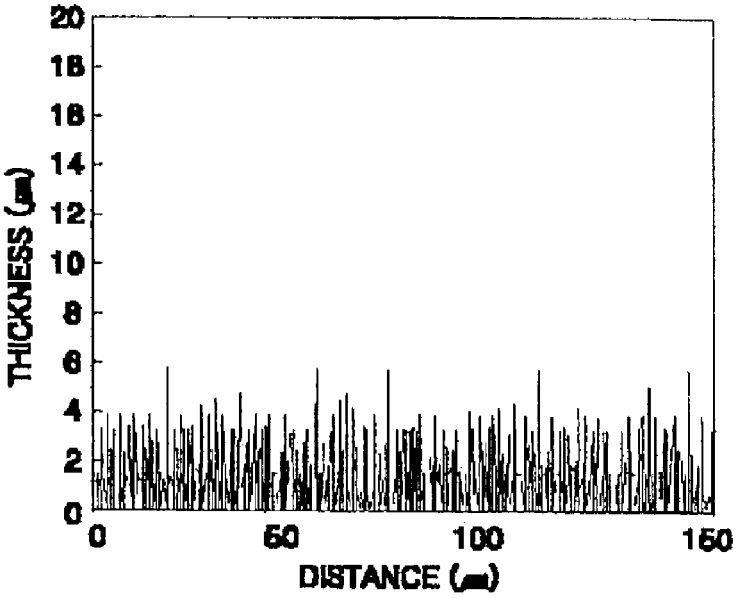
FIG. 6 is a graph showing the thickness uniformity of an image developed using a liquid developer having a Dv/Dn value of 1.71, according to the present invention.

FIG. 5 shows an image developed using the liquid developer having a Dv/Dn value of 1.81, prepared in example 1. As is apparent from FIG. 5, a high-resolution image without defective flow pattern is formed. FIG. 6 is a graph showing the thickness uniformity of the image developed using the liquid developer having a Dv/Dn value of 1.71, prepared in example 2. As is evident from FIG. 6, the thickness of the image is uniform. In other words, the liquid developers according to the present embodiment can enhance the resolution and thickness uniformity of images, compared to the conventional liquid developer.

As described above, a liquid developer according to the embodiment of the present invention contains fine toner particles of a uniform size and forms high-quality images having a uniform thickness. A liquid developer preparation method according to the present embodiment is environmentally friendly, simple, and cost effective because no cosolvent is used, thus eliminating the need for a cosolvent removal process.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A liquid developer comprising:

a mixture of an organosol, a pigment, a charge control agent, and a hydrocarbon solvent, the mixture having a volume-average to number-average particle diameter ratio of 1.5–2.5.

2. The liquid developer of claim 1, wherein the organosol comprises:

a core including ethylmethacrylate; and a shell including lauryl methacrylate.

3. The liquid developer of claim 1, wherein the pigment is selected from the group consisting of phthalocyanine blue, monoarylide yellow, diarylide yellow, arylamide yellow, azo red, quinachridone magenta, naphthol yellow, carbon black, and a mixture thereof.

4. The liquid developer of claim 1, wherein the charge control agent is selected from the group consisting of metal salts of fatty acids, metal salts of sulfo-succinates, metal salts of oxyphosphates, metal salts of alkyl-benzenesulfonic acid, metal salts of aromatic carboxylic acids and sulfonic acids, polyoxyethylated alkylamines, lecithin, polyvinylpyrrolidone, basic barium petronate, and calcium petronate.

5. The liquid developer of claim 1, wherein the hydrocarbon solvent is selected from the group consisting of ISOPAR G, ISOPAR H, ISOPAR M, ISOPAR V, NORPAR 12, and NORPAR 15.

6. The liquid developer of claim 1, wherein the volume-average particle diameter is 1.3 $\mu$m or less.

7. The liquid developer of claim 1, wherein the volume-average to number-average particle diameter ratio is 1.7–2.0.

8. The liquid developer of claim 1, wherein the organosol comprises a core formed of a thermoplastic resin.

9. The liquid developer of claim 8, wherein the core is ethylmethacrylate.

10. The liquid developer of claim 9, wherein the organosol further comprises a shell formed of an amphipathic stabilizer.

11. A method of preparing a liquid developer, the method comprising:

synthesizing an organosol using ethymethacrylate (EMA) for a core and lauryl methacrylate (LMA) for a shell;

mixing the organosol with a pigment in a mass ratio of 1:4–1:10;

adding a charge control agent to the organosol/pigment mixture until a mass ratio of the charge control agent to the pigment is between 1:0.055 and 1:0.025;

mixing the charge control mixture with a hydrocarbon solvent while adjusting a solid percentage in a resulting dispersion; and milling the dispersion while monitoring a ratio of a volume-average particle diameter of the dispersion to a number-average particle diameter of the dispersion is in the range of 1.5–2.5.

12. The method of claim 11, wherein the milling is performed at 100–10,000 rpm for 0.3–24 hours.

13. The method of claim 11, wherein the pigment is selected from the group consisting of phthalocyanine blue, monoarylide yellow, diarylide yellow, arylamide yellow, azo red, quinachridone magenta, naphthol yellow, carbon black, and a mixture thereof.

14. The method of claim 11, wherein the charge control agent is selected from the group consisting of metal salts of fatty acids, metal salts of sulfo-succinates, metal salts of oxyphosphates, metal salts of alkyl-benzenesulfonic acid, metal salts of aromatic carboxylic acids and sulfonic acids, polyoxyethylated alkylamines, lecithin, polyvinylpyrrolidone, basic barium petronate, and calcium petronate.

15. The method of claim 11, wherein the hydrocarbon solvent is selected from the group consisting of ISOPAR G, ISOPAR H, ISOPAR M, ISOPAR V, NORPAR 12, and NORPAR 15.

16. The method of claim 11, further comprising:

controlling the ratio of the volume-average particle diameter to the number-average particle diameter by varying a rate of the milling or a time of the milling.

17. The method of claim 11, wherein a solid content of the dispersion is less than 25% by weight.

18. The method of claim 11, wherein the milling is basket milling, attrition milling, or Dino milling.

* * * * *

UNITED STATES PATENT AND TRADEMARK OFFICE

CERTIFICATE OF CORRECTION

PATENT NO. : 6,951,703 B2
DATED : October 4, 2005
INVENTOR(S) : Seong-joon Chae et al.

It is certified that error appears in the above-identified patent and that said Letters Patent is hereby corrected as shown below:

Column 7,
Line 8, replace "ethymethacrylate" with -- ethylmethacrylate --.

Signed and Sealed this

Thirtieth Day of May, 2006

JON W. DUDAS
*Director of the United States Patent and Trademark Office*